US007681279B2

(12) United States Patent
Kelly

(10) Patent No.: US 7,681,279 B2
(45) Date of Patent: Mar. 23, 2010

(54) VACUUM CLEANER

(75) Inventor: David Kelly, Roslin (GB)

(73) Assignee: Hoover Limited, Mid Glamorgan (GB)

( * ) Notice: Subject to any disclaimer, the term of this patent is extended or adjusted under 35 U.S.C. 154(b) by 311 days.

(21) Appl. No.: 11/567,345

(22) Filed: Dec. 6, 2006

(65) Prior Publication Data

US 2007/0130723 A1 Jun. 14, 2007

(30) Foreign Application Priority Data

Dec. 8, 2005 (GB) ..... 0525032.9

(51) Int. Cl.
*A47L 9/32* (2006.01)

(52) U.S. Cl. ..... 15/323; 15/410

(58) Field of Classification Search ..... 15/323, 15/339, 351, 410; *A47L 9/32*
See application file for complete search history.

(56) References Cited

U.S. PATENT DOCUMENTS

| | | | |
|---|---|---|---|
| 4,644,605 | A | 2/1987 | Joss et al. |
| 6,941,615 | B2 | 9/2005 | Shanor et al. |

FOREIGN PATENT DOCUMENTS

| | | |
|---|---|---|
| EP | 1033101 | 9/2000 |
| GB | 1036643 | 7/1966 |
| JP | 2001218717 | 8/2001 |
| WO | WO 2004/096000 | 11/2004 |

*Primary Examiner*—David A Redding
(74) *Attorney, Agent, or Firm*—Gordon & Jacobson, PC

(57) ABSTRACT

A vacuum cleaner comprising: a cleaner body 3; an elongate handle 5 connected to the cleaner body, the elongate handle being movable between an extended position, extending outwardly from the cleaner body, and a stowed position, in which the elongate handle is positioned substantially adjacent to the cleaner body; wherein the vacuum cleaner further comprises a carry handle 11 which becomes accessible for use when the elongate handle is moved from the extended to the stowed position.

15 Claims, 8 Drawing Sheets

VACUUM CLEANER

The present application claims priority from UK Patent Application No. 0525032.9, herein incorporated by reference in its entirety.

The present invention relates to a vacuum cleaner.

BACKGROUND OF THE INVENTION

So-called stick vacuum cleaners are well known. They have an elongate structure comprising a floor-engaging nozzle or tool, a housing enclosing a separating device, typically a filter bag and a motor-fan unit, and an elongate handle with which the cleaner is propelled and guided over the surface being cleaned. Stick cleaners can be excessively long, some examples being as long as 150 cm, which can render handling and storage of the cleaner difficult.

EP 1033101 discloses an electric cleaner appliance with a foldaway handle which can be fully extended or stowed away. The electric cleaner also has a laterally placed handle situated substantially at the centre of gravity of the appliance. The laterally placed handle is described as being more convenient to hold the appliance when the foldaway handle is stowed. However as the laterally placed handle is situated substantially at the centre of gravity of the appliance and is fixed in position it is inconvenient for picking up and moving the appliance when the foldaway handle is stowed.

SUMMARY OF THE INVENTION

An object of the present invention is to provide a vacuum cleaner with improved ergonomics for storing and carrying the cleaner, particularly for transporting the cleaner to and from its storage location.

The present invention relates to a vacuum cleaner comprising:

a cleaner body;

an elongate handle connected to the cleaner body, the elongate handle being movable between an extended position, extending outwardly from the cleaner body, and a stowed position, in which the elongate handle is positioned substantially adjacent to the cleaner body;

wherein the vacuum cleaner further comprises a carry handle which becomes accessible for use when the elongate handle is moved from the extended to the stowed position.

The present invention provides a vacuum cleaner with a carry handle that becomes accessible for use when the elongate handle is moved from the extended to the stowed position so the carry handle is convenient for picking up and moving the vacuum cleaner when the elongate handle is stowed.

The carry handle is preferably positioned intermediate the cleaner body and the elongate handle.

The carry handle preferably moves from a latent position to an access position as the elongate handle is moved from the extended position to the stowed position. When the elongate handle is stowed the carry handle is advantageously accessible and ready for use without requiring any further action from the user.

Preferably in the latent position the carry handle substantially conforms with the shape of the outer surface of the cleaner body and elongate handle in an area adjacent the carry handle so the vacuum cleaner maintains a streamlined form and manoeuverability.

The elongate handle preferably folds from the extended to the stowed position.

The elongate handle is pivotally mounted and may be pivotally connected to the cleaner body.

The carry handle is preferably pivotally mounted. The carry handle is advantageously moveable in position allowing the handle to be grasped from various angles increasing the ease with which the pivotally mounted carry handle can be used when the elongate handle is in its stowed position.

The carry handle preferably has a common pivotal axis with the elongate handle.

The carry handle is preferably prevented from moving from its access position to the latent position when the elongate handle is in its stowed position so that the movement of the cleaner body relative to the carry handle is limited to improve control over the vacuum cleaner when it is being carried by the carry handle.

The carry handle can preferably be moved from its access position to a second latent position when the elongate handle is in its stowed position to reduce the height of the vacuum cleaner when the elongate handle is in its stowed position and the vacuum cleaner is e.g. being stored. The space required for storing the vacuum cleaner is advantageously reduced.

Preferably the carry handle is mechanically engaged with the elongate handle. Advantageously movement of the elongate handle can be effectively transmitted to the carry handle.

Preferably the carry handle has a protrusion which engages in a recess in the elongate handle such that as the elongate handle is pivoted between the extended position and the stowed position the protrusion is moved with the recess causing the carry handle to pivot from a latent to an access position. Advantageously the connection between the elongate handle and the carry handle is a simple connection minimising moving parts.

The carry handle is preferably substantially U-shaped so it can be easily gripped.

The vacuum cleaner preferably comprises means to hold the elongate handle in its stowed position so the elongate handle can be secured in its stowed position and the cleaner can be easily transported or used when the elongate handle is stowed.

The vacuum cleaner preferably further comprising a handgrip portion spaced from the carry handle to aid in manoeuvring the vacuum cleaner when the elongate handle is stowed.

An embodiment of this invention will now be further described by way of example only and with reference to the accompanying drawings.

DETAILED DESCRIPTION OF THE PREFERRED EMBODIMENTS

Figure 1:
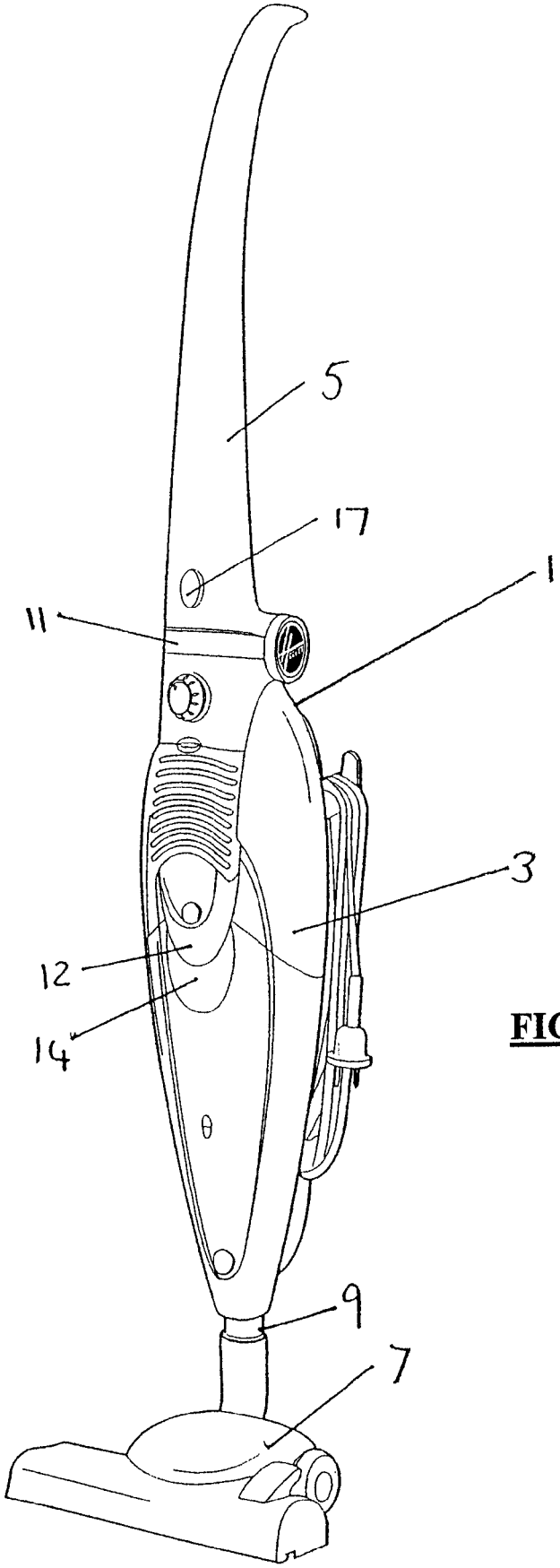
FIG. 1 is a side and front view of a vacuum cleaner.

FIG. 1 shows a stick-type vacuum cleaner 1 having a cleaner body 3 and an elongate handle 5 (hereinafter referred to as "handle"). The handle 5 is shown in its extended position in which it extends outwardly from the cleaner body 3. The cleaner body has an upper extremity to which the handle 5 is connected and a lower extremity at which is positioned a suction port 9. The cleaner body 3 is in fluid connection, via the suction port 9, with e.g. floor engaging nozzle unit 7. The cleaner body 3 houses means for effecting suction of air through the suction port, such as a motor/fan unit (not shown), and means for receiving air from the suction port and arranged to remove and collect dirt and dust from the air. The means arranged to remove and collect dirt and dust from the air (not shown) may be a filter bag or other receptacle for dirt and dust. In the extended position the cleaner body 3 and the handle 5 are disposed in a substantially end to end relationship with a substantially common axis. The cleaner body is also provided with a hand-grip portion 12 which extends over a recessed portion 14 into which the fingers can be inserted to grip the hand-grip portion 12.

In use the motor/fan unit draws air and dirt/dust from the surface to which the cleaner is applied up through the suction nozzle via the suction port 9 to the means arranged to remove and collect dirt and dust from the air. The handle 5 is used to guide and propel the cleaner over the surface to be cleaned.

The stick cleaner 1 has a carry handle 11 intermediate the handle 5 and cleaner body 3, which is disposed in a latent position when the handle is in the extended position shown in FIG. 1. The carry handle 11 substantially conforms with the shape of the outer surface of cleaner body 3 and handle 5 in the area adjacent the carry handle 11. The carry handle 11 rests in contact with the upper end of cleaner body 3 and is positioned in a recess which extends around the outer surface of the upper end of cleaner body 3.

Figure 2:
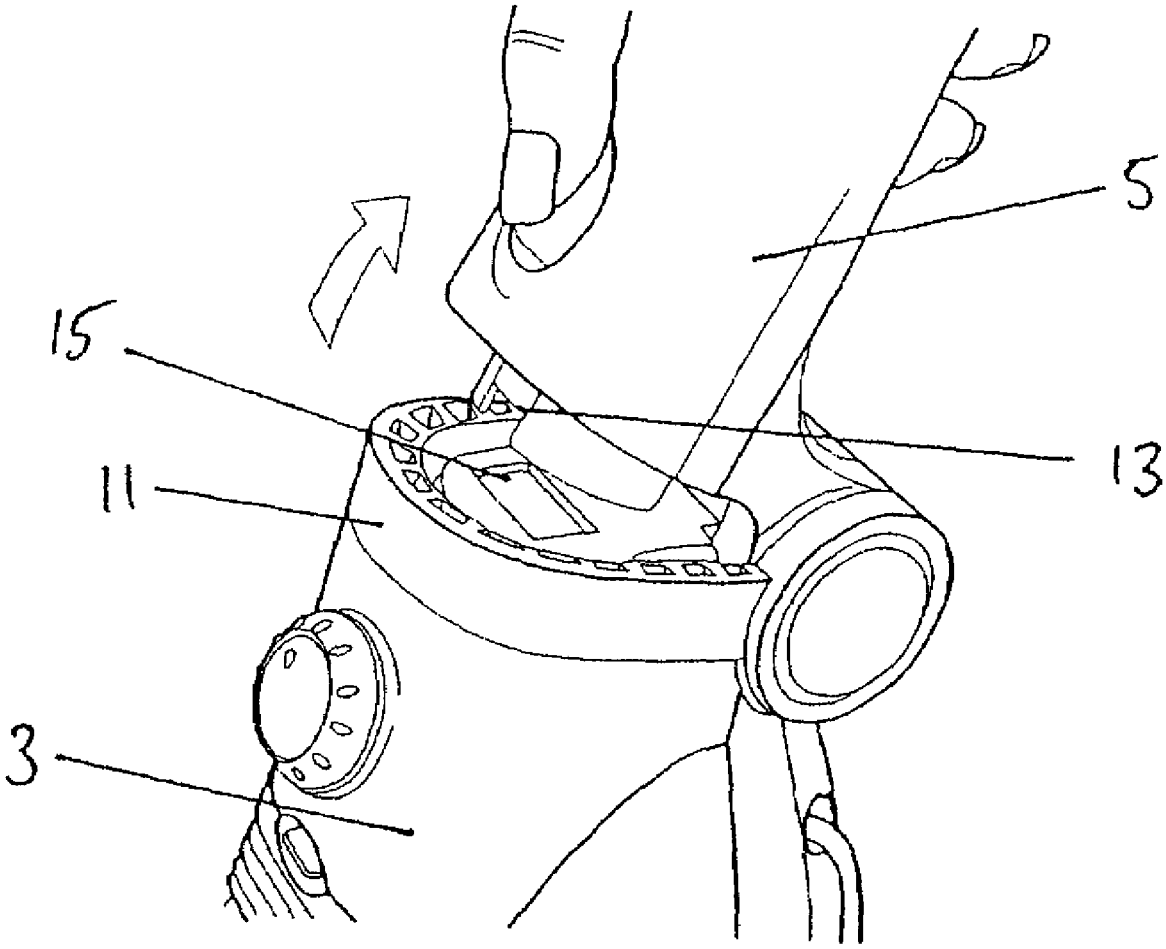
FIG. 2 is a partial view of a vacuum cleaner.

Referring to FIG. 2, the handle 5 is held in its first extended position by catch means in the form of a biased lug 13 on the handle 5 which engages with a corresponding recess 15 in the body portion 3. The lug 13 can be moved horizontally against the bias e.g. by application of pressure to activation button 17 allowing it to be released from the recess 15. The handle 5 is pivotally connected to the cleaner body 3.

Figure 3:
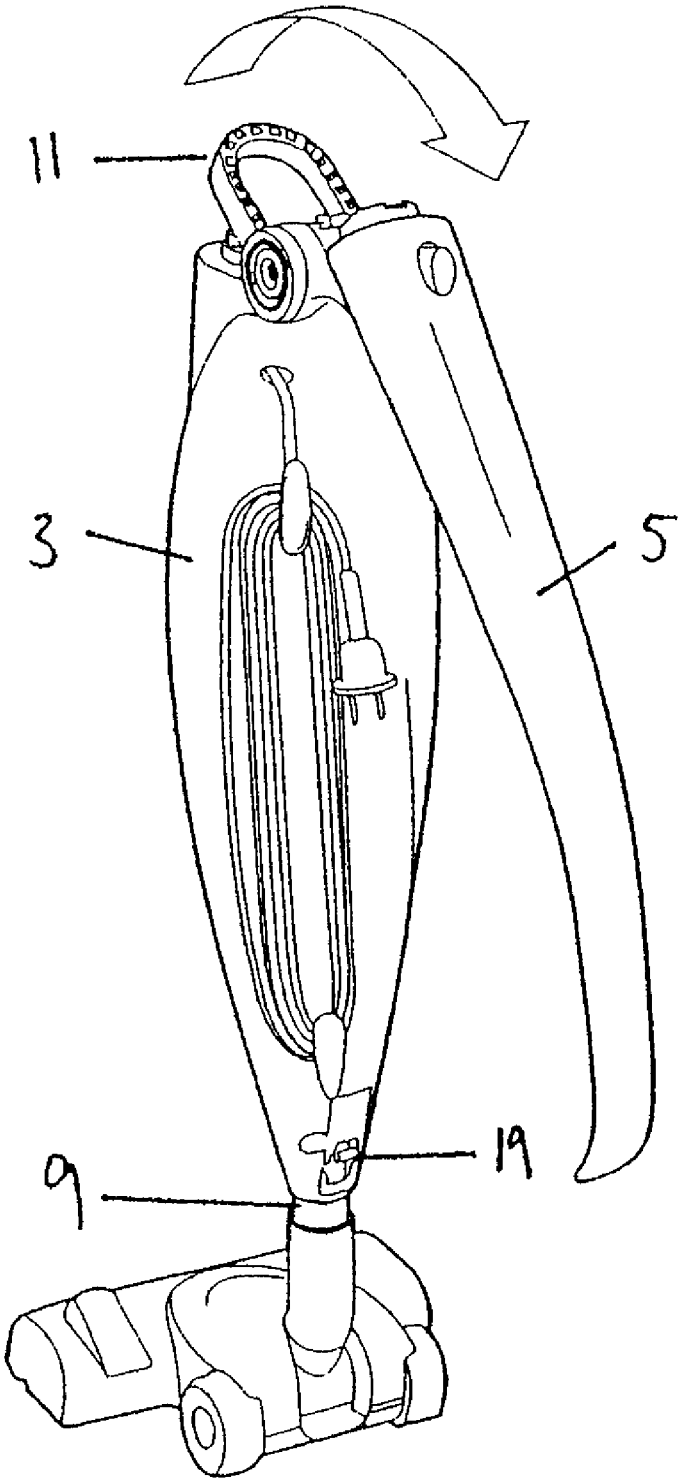
FIG. 3 is a rear and side view of a vacuum cleaner.

FIG. 3 shows the stick cleaner 1 as the handle 5 is pivoted from its extended position to the stowed position in which it is folded down substantially adjacent to the cleaner body 3. The carry handle 11 is deployed into an access position, extending from the upper extremity of the cleaner body, as the handle 5 pivots from its extended position to its stowed position. The carry handle 11 and handle 5 have a common pivotal axis. The handle 5 is held in place in its stowed position by engaging with catch means 19 at the lower extremity of the cleaner body 3, where the lower extremity is the end nearest the suction port 9. The handle may snap-fit into catch means 19.

Figure 4:
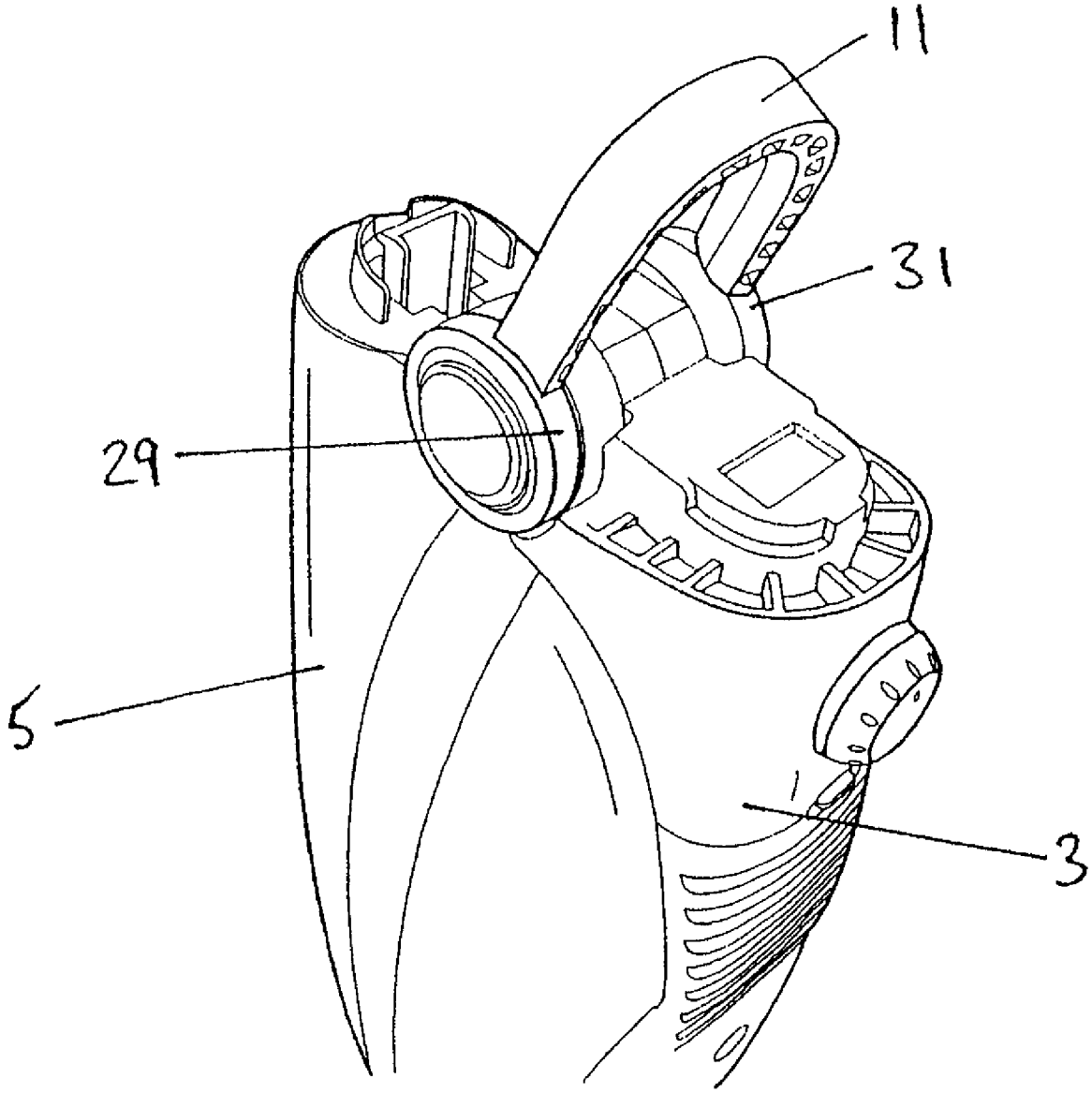
FIG. 4 is a partial view of a vacuum cleaner.

FIG. 4 shows the handle 5 folded down in its stowed position with its axis substantially parallel to the axis of the cleaner body 3 and the carry handle 11 in its access position extending or projecting upwardly from the upper extremity of the cleaner body 3.

Figure 5:
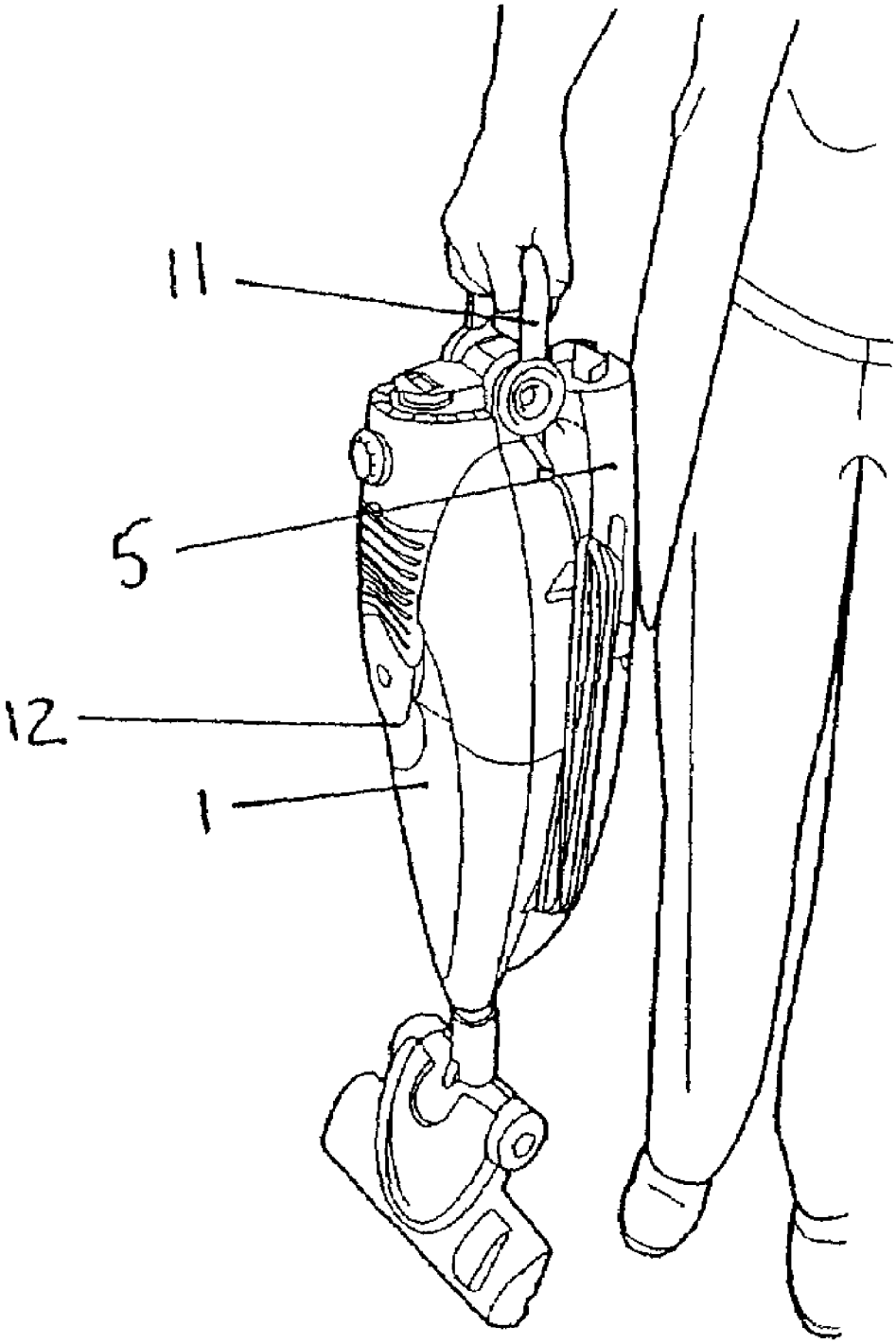
FIG. 5 is a front and side view of a vacuum cleaner.

FIG. 5 shows the carry handle 11 being used to pick up and transport the stick cleaner 1 when the handle 5 is in its stowed position and the cleaner is not in use.

Figure 6:
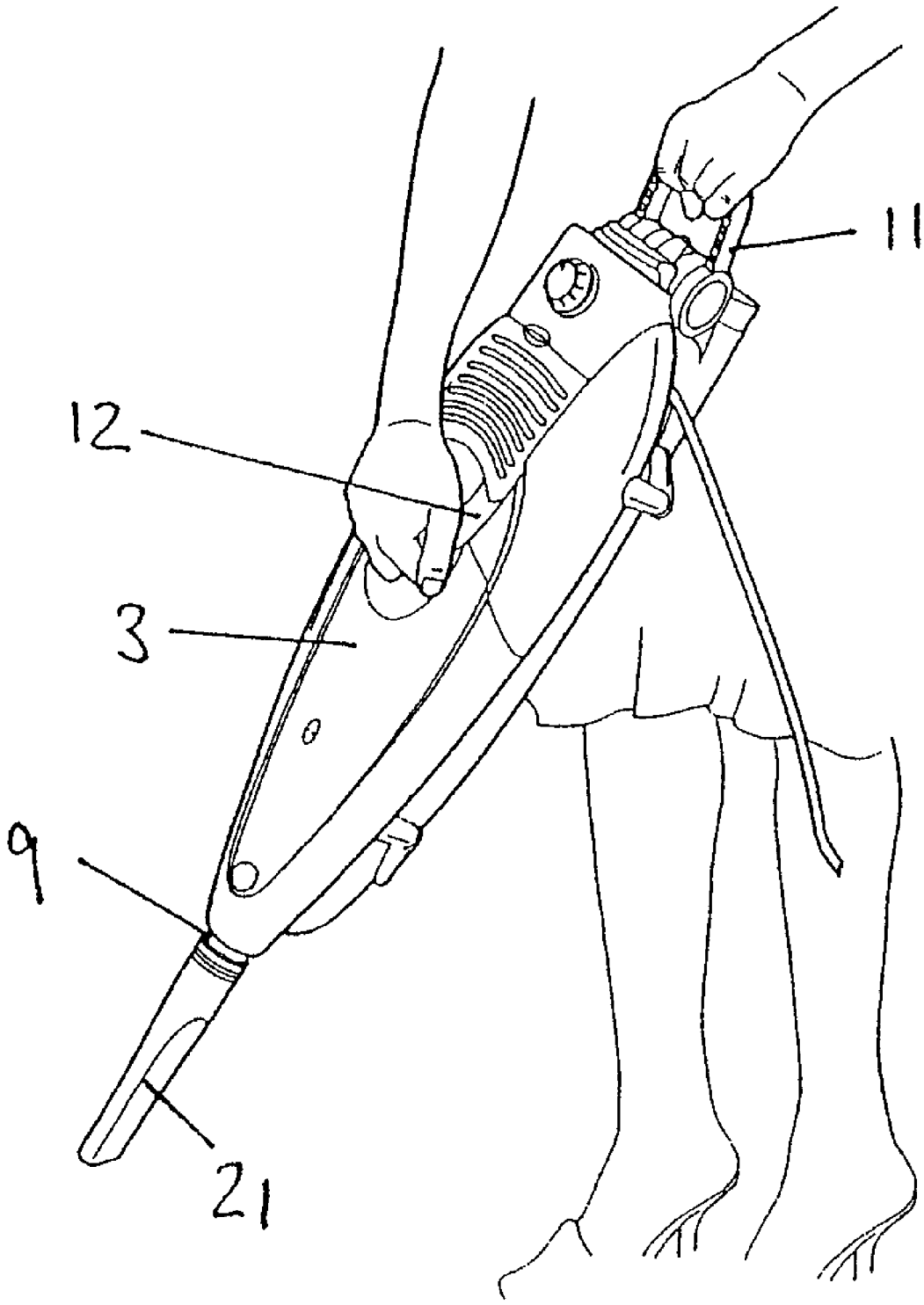
FIG. 6 is a front and side view of a vacuum cleaner.

FIG. 6 shows how the carry handle 11 can also be used to support and guide the cleaner body 3 when the cleaner is in use with the handle 5 in its stowed position. The hand-grip portion 12 is further used to support and guide the cleaner body 3 when the handle 5 is in the stowed position. The suction port 9 of the cleaner body in this case is attached to an elongate crevice tool 21 suitable for e.g. cleaning upholstery or "hard to reach" areas of surfaces such as corners.

Figure 7:
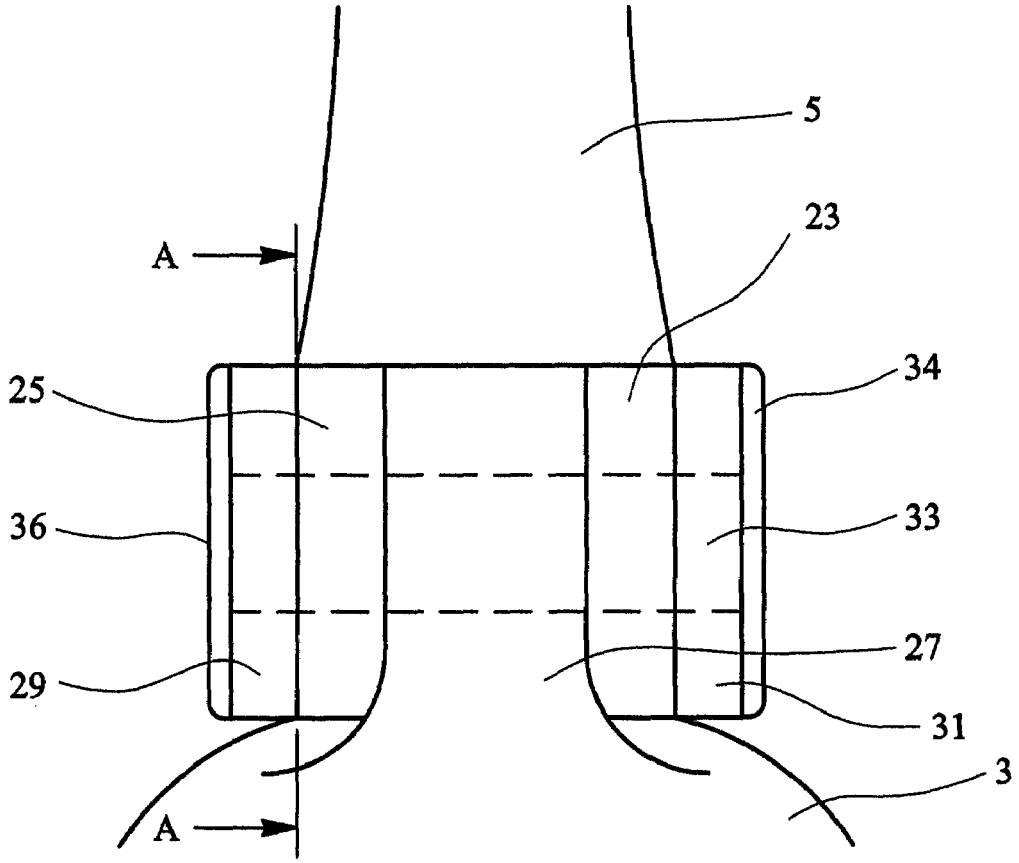
FIG. 7 is an enlarged view of part of the vacuum cleaner.

FIG. 7 illustrates the mechanism by which the carry handle 11 is deployed as handle 5 is moved from its extended position to its stowed position. Handle 5 has two spaced protruding portions 23,25, each having a central bore, disposed on its lower end, where the lower end is the end at which it is connected to the cleaner body. Cleaner body 3 has one protruding portion 27, also having a central bore, disposed on its upper end. The protruding portion 27 of cleaner body 3 is inserted between the protruding portions 23,25 of handle 5 so that the bores are in alignment. Carry handle 11 is substantially U-shaped and has a bore through the end portions 29,31 of the members making up the two sides of the U. The end portions 29,31 are disposed around the protruding portions 23,25 of handle 5 so that the bores are aligned and a spindle 33 is inserted through the bores of protruding portions 23,25,27 and end portions 29,31. The rotational axis of the pivot 33 thus passes through the free ends of the substantially U-shaped carry handle 11 through end portions 29,31. Spindle 33 is retained in the bores by retaining means 36,34 affixed to the outer edges of end portions 29,31.

Figure 8:
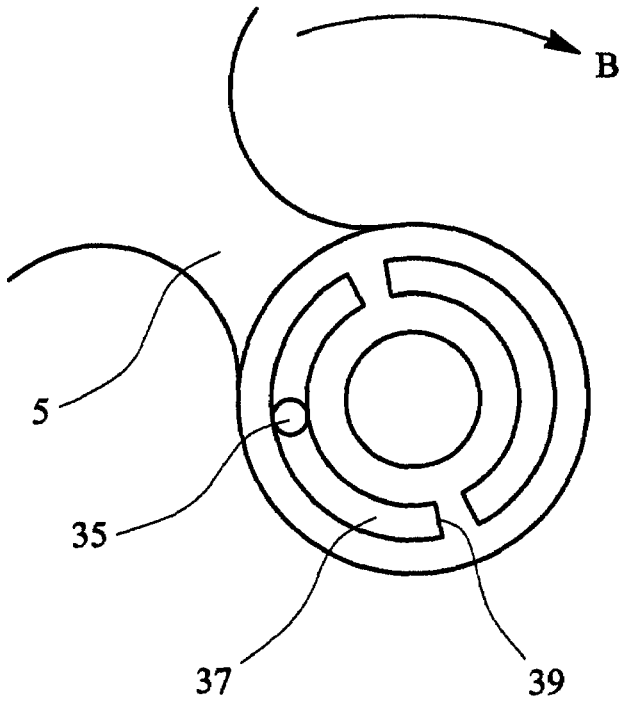
FIG. 8 is a sectional view along the line A in FIG. 7.

FIG. 8 shows a cross-section along line A of FIG. 7. The end portion 29 of carry handle 11 has a protrusion in the form of a peg 35 which extends inwardly towards the respective protruding portion 25 of the handle 5. The peg 35 fits into arcuate recess 37 in the protruding portion 25. As the main handle 5 is pivoted from its extended to its stowed position, in the direction of arrow B, the end wall 39 of the recess 37 engages and moves peg 35 thereby rotating carry handle end portion 29 as the portion 25 of the main handle 5 rotates. The carry handle is thereby moved from a latent position as shown in FIGS. 1 and 2 to the access position shown in FIGS. 4, 5 and 6. Preferably both end portions 29, 31 of carry handle 11 have protrusions which fit into recesses in both protruding portions 23,25 of handle 5.

Figure 9:
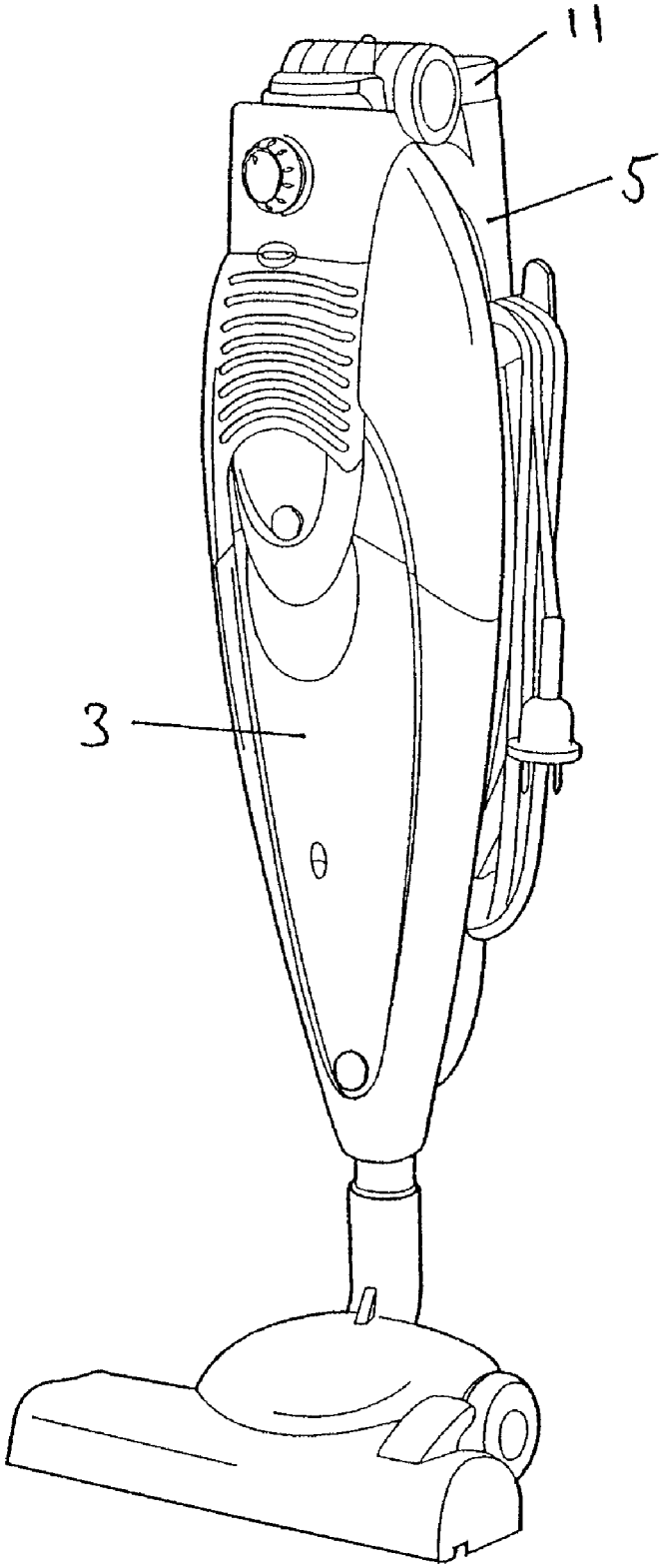
FIG. 9 is a front and side view of a vacuum cleaner.

Once the handle 5 has been moved to its stowed position the end wall 39 of the recess 37 prevents the carry handle 11 from moving in the direction opposite to arrow B in FIG. 8 back to its original latent position. However the carry handle 11 can still move in the direction of arrow B in FIG. 8 to a second latent position shown in FIG. 9 once the handle 5 has moved to its stowed position. The carry handle 11 can thus be pivoted down towards the handle 5 until it rests in contact with the lower end of handle 5 when the handle is in its stowed position, thereby reducing the height of the cleaner when it is in a stowed position as shown in FIG. 9. As can be seen from FIG. 9, in its second latent position the outer surface of the carry handle 11 is preferably substantially in line with the outer surface of handle 5 in the area adjacent the carry handle 11.

In another aspect that is not illustrated the carry handle end portions may be provided with a recess, into which a peg attached to a protruding portion of the main handle 5 fits. This aspect would operate in a manner similar to that described above to move carry handle 11 as handle 5 is moved from an extended position to a stowed position.

The carry handle end portions may alternatively be disposed between the protruding portions of the handle 25. Alternatively the handle 5 may have only one protruding portion and/or the cleaner body 3 may have more than one protruding portion.

One or more of the end portions of handle 11 may alternatively not be provided with a bore or be provided with a partial bore, although the spindle will extend at least through the protruding portions of the handle 5 and cleaner body 3.

It is to be understood that modifications and variations of the present invention will become apparent to those skilled in the art and it is intended that all such modifications will be included within the scope of the present invention.

The invention claimed is:

1. A vacuum cleaner comprising:

a cleaner body;

an elongate handle connected to the cleaner body, the elongate handle being movable between an extended position, extending outwardly from the cleaner body, and a stowed position, in which the elongate handle is positioned substantially adjacent to the cleaner body; and a carry handle having a first configuration inaccessible for use when the elongate handle is in the extended position and a second configuration accessible for use when the elongate handle is in the stowed position, wherein the carry handle is positioned intermediate the cleaner body and the elongate handle.

2. A vacuum cleaner according to claim 1, wherein the carry handle moves from a latent position to an access position as the elongate handle is moved from the extended position to the stowed position.

3. A vacuum cleaner according to claim 2, wherein the cleaner body and elongate handle have an outer surface and in the latent position the carry handle substantially conforms with the shape of the outer surface of the cleaner body and elongate handle in an area adjacent the carry handle.

4. A vacuum cleaner according to claim 1, wherein the elongate handle folds from the extended to the stowed position.

5. A vacuum cleaner according to claim 1, wherein the elongate handle is pivotally mounted.

6. A vacuum cleaner according to claim 5, wherein the elongate handle is pivotally connected to the cleaner body.

7. A vacuum cleaner according to claim 1, wherein the carry handle is pivotally mounted.

8. A vacuum cleaner according to claim 7, wherein the carry handle and the elongate handle pivot about a common pivotal axis.

9. A vacuum cleaner according to claim 2, wherein the carry handle is prevented from moving from its access position to the latent position when the elongate handle is in its stowed position.

10. A vacuum cleaner according to claim 9, wherein the carry handle can be moved from its access position to a second latent position when the elongate handle is in its stowed position.

11. A vacuum cleaner according to claim 1, wherein the carry handle is mechanically engaged with the elongate handle.

12. A vacuum cleaner according to claim 1, wherein the carry handle has a protrusion which engages in a recess in the elongate handle such that as the elongate handle is pivoted between the extended position and the stowed position the protrusion is moved with the recess causing the carry handle to pivot from a latent to an access position.

13. A vacuum cleaner according to claim 1, wherein the carry handle is substantially U-shaped.

14. A vacuum cleaner according to claim 1, further comprising means to hold the elongate handle in its stowed position.

15. A vacuum cleaner according to claim 1, further comprising a hand-grip portion spaced from the carry handle.

* * * * *